US011097149B2

(12) United States Patent
Wagner

(10) Patent No.: US 11,097,149 B2
(45) Date of Patent: Aug. 24, 2021

(54) PHYSICAL THERAPY SYSTEM

(71) Applicant: Kimberly R. Wagner, Vista, CA (US)

(72) Inventor: Kimberly R. Wagner, Vista, CA (US)

( * ) Notice: Subject to any disclaimer, the term of this patent is extended or adjusted under 35 U.S.C. 154(b) by 21 days.

(21) Appl. No.: 16/438,233

(22) Filed: Jun. 11, 2019

(65) Prior Publication Data

US 2020/0391072 A1 Dec. 17, 2020

(51) Int. Cl.

| | |
|---|---|
| ***A63B 21/00*** | (2006.01) |
| ***A63B 21/002*** | (2006.01) |
| ***A63B 69/36*** | (2006.01) |
| ***A63B 23/20*** | (2006.01) |
| ***A63B 23/12*** | (2006.01) |

(52) U.S. Cl.

CPC ..... *A63B 21/4011* (2015.10); *A63B 21/0023* (2013.01); *A63B 21/4039* (2015.10); *A63B 23/1236* (2013.01); *A63B 23/20* (2013.01); *A63B 69/3608* (2013.01)

(58) Field of Classification Search

CPC ..... A63B 21/4011; A63B 21/0023; A63B 69/3608; A63B 23/20; A63B 21/4039; A63B 23/1236

See application file for complete search history.

(56) References Cited

U.S. PATENT DOCUMENTS 3,266,061 A * 8/1966 Fuechsel ..... A47C 27/146 5/600
4,045,033 A * 8/1977 Schuman ..... A63B 69/0059 473/266
4,372,299 A * 2/1983 Fixel ..... A61F 5/0193 5/648
4,830,366 A * 5/1989 Ruden ..... A63B 21/028 482/122
5,216,771 A * 6/1993 Hoff ..... A47C 20/021 5/490
D349,541 S * 8/1994 Bertolucci ..... D21/686
5,348,523 A * 9/1994 Blount ..... A63B 21/078 482/104
5,681,270 A * 10/1997 Klearman ..... A61F 5/012 128/845
5,895,366 A * 4/1999 Bzoch ..... A61F 5/012 128/845
6,154,905 A * 12/2000 Frydman ..... A47C 20/021 128/845
6,179,756 B1 * 1/2001 Bertolucci ..... A63B 21/0023 482/131
6,438,779 B1 * 8/2002 Brown ..... A47C 20/021 128/845

(Continued)

*Primary Examiner* — Gary D Urbiel Goldner

(57) ABSTRACT

A versatile physical therapy system for aiding in pelvic alignment, shoulder support and isometric exercise features a support body, comprising: a support body face, a support body back, a support body front, a support body back, a support body left side, and a support body right side, a left notch, and a right notch. The support body front may feature a first hook and loop component; and the support body back may feature a second hook and loop component. The system may feature a support strap having means to secure the support strap to the support body when in place on a user. The support strap holds the support body in place when the user compresses the support body and permits the user to engage in outward isometric exercise while holding the support body in place.

18 Claims, 5 Drawing Sheets

(56) References Cited

U.S. PATENT DOCUMENTS

| | | | | |
|---|---|---|---|---|
| 6,578,218 | B2 * | 6/2003 | Wassilefsky | A47C 20/021 5/630 |
| 6,640,368 | B2 * | 11/2003 | Roston | A47C 20/021 5/648 |
| 7,182,717 | B2 * | 2/2007 | Tangios | A63B 21/028 482/112 |
| 7,223,217 | B1 * | 5/2007 | Liao | A63B 21/0004 482/122 |
| 7,677,249 | B2 * | 3/2010 | Kong | A61G 13/0081 128/845 |
| D639,101 | S * | 6/2011 | Kalatsky | A63B 69/0059 D6/601 |
| 8,931,837 | B2 * | 1/2015 | Vernon | A47C 7/46 297/230.1 |
| D726,264 | S * | 4/2015 | Agate | D21/682 |
| 9,522,095 | B2 * | 12/2016 | Steele | A61H 9/005 |
| 10,130,839 | B2 * | 11/2018 | Sadvakassov | A63B 23/08 |
| 10,398,922 | B1 * | 9/2019 | Pasterino | A63B 21/0407 |
| 10,588,788 | B2 * | 3/2020 | Marquez | A61G 13/123 |
| 2004/0198570 | A1 * | 10/2004 | Tangios | A63B 23/0488 482/111 |
| 2005/0273934 | A1 * | 12/2005 | Hunter | A47C 20/021 5/648 |
| 2006/0217248 | A1 * | 9/2006 | Diseati | A63B 21/028 482/128 |
| 2008/0092297 | A1 * | 4/2008 | Davis | A47C 20/021 5/648 |
| 2012/0004079 | A1 * | 1/2012 | Hyacinth | A63B 69/0059 482/92 |
| 2014/0342888 | A1 * | 11/2014 | Cecil | A63B 23/12 482/142 |

* cited by examiner

PHYSICAL THERAPY SYSTEM

FIELD OF THE INVENTION

The present invention relates to physical therapy and exercise devices and systems.

BACKGROUND OF THE INVENTION

Bodily pain comes in many different forms and plagues many people. For some, it can be pain in the back or joints. There are many different approaches to address bodily pain including medicine, surgery, physical therapy, and alternative or preventative methods. The present invention features a versatile physical therapy system for aiding in pelvic alignment, shoulder support, and isometric exercise.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a versatile physical therapy system for aiding in pelvic alignment, shoulder support, and isometric exercise. In some embodiments, the system comprises a support body having a support body face, a support body bottom, a support body front, a support body back, and a pair of support body notches in a support body left side, and a support body right side.

In some embodiments, the support body left side comprises a left notch centrally located therein. In some embodiments, the left notch is located from the support body front to the support body back. In some embodiments, the support body right side comprises a right notch centrally located therein. In some embodiments, the right notch is located from the support body front to the support body back.

In some embodiments, a first hook and loop component is centrally located on the support body front. The first hook and loop component is suitable for reversible engagement with a second hook and loop component on a support strap. In some embodiments, a third hook and loop component is centrally located on the support body back. The third hook and loop component is suitable for reversible engagement with a fabric on the support strap.

In some embodiments, the system comprises a support strap having a strap first end and a strap second end. In some embodiments, the strap first end comprises a fourth hook and loop component located thereon next to a strap first end terminating edge. In some embodiments, the support strap comprises a second hook and loop component located near the strap second end, which is suitable for engagement with the first hook and loop component on the support body. In some embodiments, the support strap further comprises a buckle at the strap first end, which is adapted to permit the support strap first end to pass therethrough, double back, and reversibly engage the fourth hook and loop component with the fabric of the support strap.

In some embodiments, the support body is placed between the thighs of a user. In some embodiments, the support body left side interfaces with a left thigh of a user next to the user's left knee. In some embodiments, the support body right side interfaces with a right thigh of the user near the user's right knee. In some embodiments, the support strap may be wrapped around an outer periphery of the left thigh and the right thigh to hold the support body firmly in position. In some embodiments, the user's pelvis may be aligned via the placement and exercise with the support body.

In some embodiments, the support body is placed on a waist side of the user. In some embodiments, either the support body left side or the support body right side interfaces with the waist side of the user. In some embodiments, the support strap is wrapped around an outer periphery of the support body and a waist of the user to hold the support body firmly in position. In some embodiments, an arm is placed on the support body front.

In some embodiments, the support body is placed between the hands of the user. In some embodiments, the user pushes against the support body for isometric exercise.

DESCRIPTION OF PREFERRED EMBODIMENTS

Figure 1:
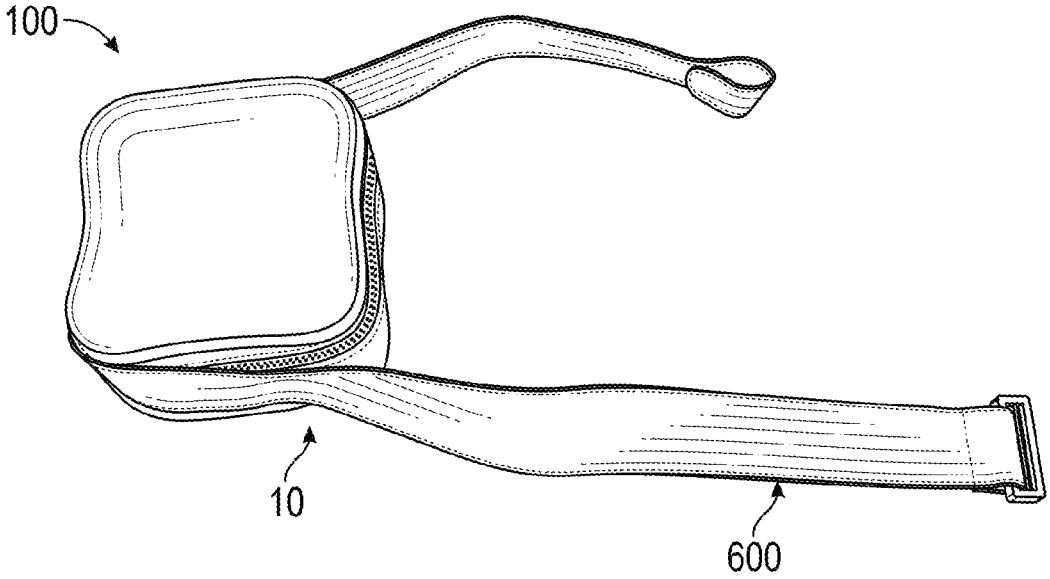
FIG. 1 shows a perspective view of a physical therapy system taught herein.
Figure 2:
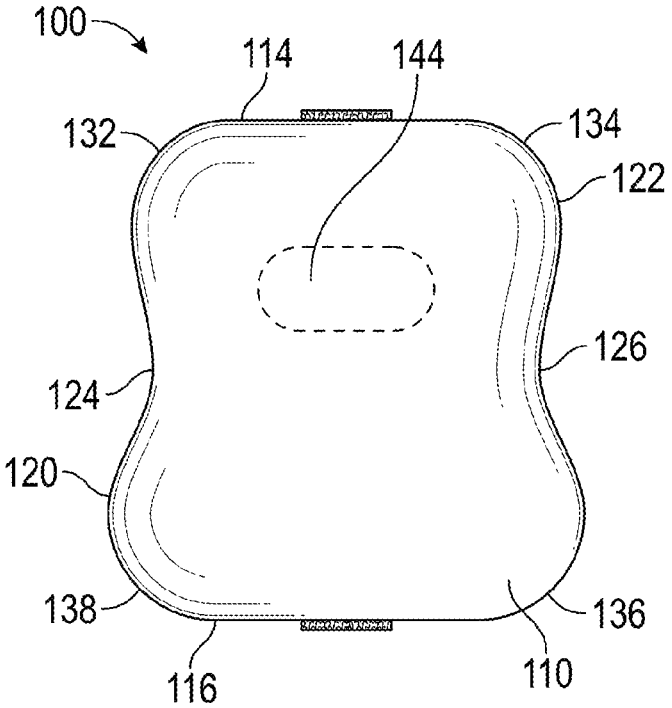
FIG. 2 shows a face view of a support body disclosed herein.
Figure 3:
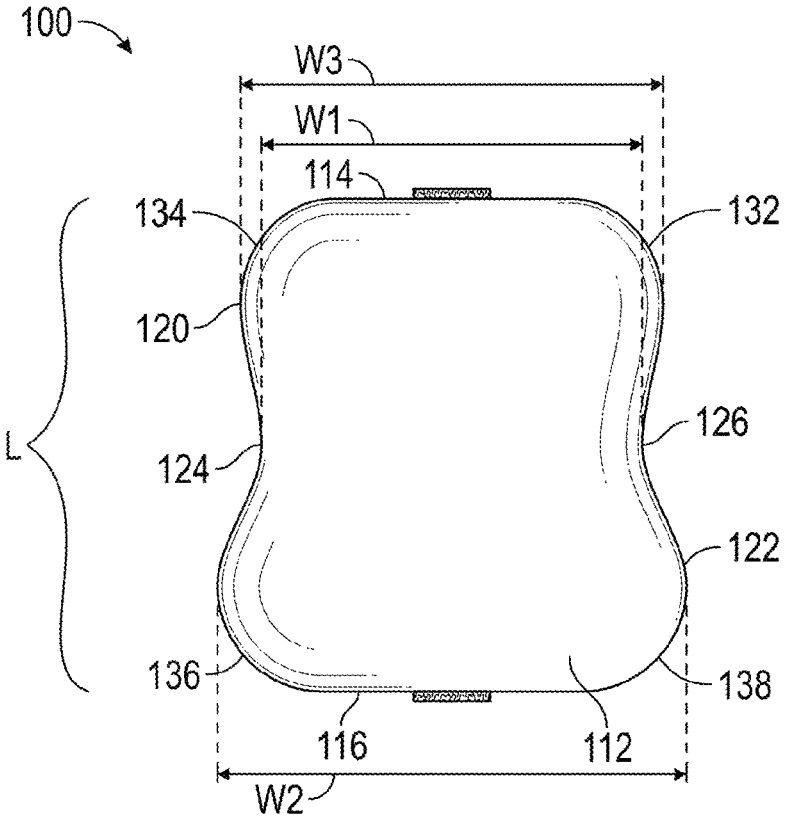
FIG. 3 shows a bottom view of a support body disclosed herein.
Figure 4:
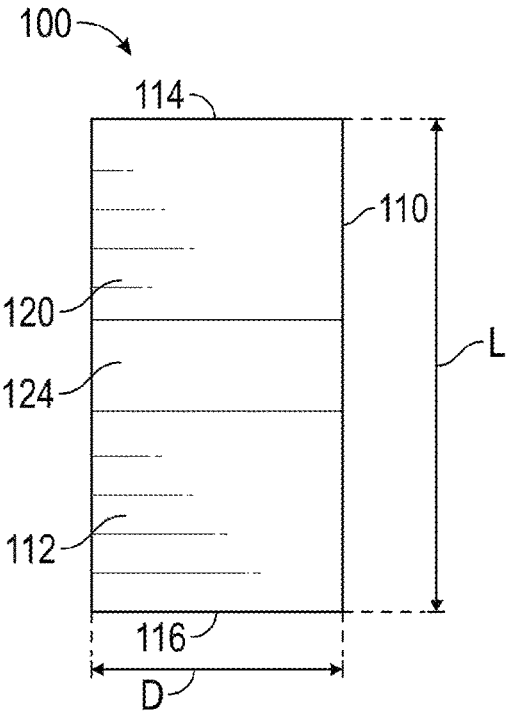
FIG. 4 shows a side view of a support body disclosed herein.

Following is a list of elements corresponding to a particular element referred to herein:

10 Physical Therapy System
100 Support body
110 Support body face
112 Support body bottom
114 Support body front
116 Support body back
120 Support body left side
122 Support body right side
124 Left notch
126 Right notch

132 Front left corner
134 Front right corner
136 Back left corner
138 Back right corner
140 First hook and loop component
142 Support body back hook component
144 Label
150 Support body cover zipper
170 Support body cover
180 Support body foam core
600 Support Strap
602 Strap back
604 Strap buckle
606 Second hook and loop component
608 Fourth hook and loop fastener component back
610 Strap first end
612 Strap front
618 Fourth hook and loop fastener component front
620 Strap second end Referring now to FIG. 1-15, there is described a physical therapy system (10) for aiding in pelvic alignment, shoulder support and isometric exercise. In some embodiments, the physical therapy system (10) comprises a support body (100) and a support strap (600). While the support body (100) and the support strap (600) are described herein as part of a physical therapy system (10), it is to be understood that in some embodiments of exercises described herein the support body (100) may be used without the support strap (600). In other embodiments of exercises described herein, the support body (100) and the support strap (600) are integrally related as essential elements of a physical therapy system (10) for carrying out the described exercises.

The support body (100) has a support body face (110), a support body bottom (112), a support body front (114), a support body back (116), a support body left side (120), and a support body right side (122). (The terms "front", "bottom", "left" and "right" are used for reader orientation and are not intended have meaning independent of one another.) The support body (100) comprises a front left corner (132), a front right corner (134), a back left corner (138) and a back right corner (136). In some embodiments one or more of the corners (132, 134, 136, and 138) may be rounded, though one or more of the corners (132, 134, 136, and 138) may be square.

The support body left side (120) comprises a left notch (124), which is an indentation in the support body left side (120). In some embodiments, the left notch (124) is located approximately midway between the front left corner (132) and the back left corner (138). In some embodiments, the left notch (124) extends from the support face (110) to the support body bottom (112). In some embodiments, the support body right side (122) comprises a right notch (126), which is an indentation in the support body right side (122). In some embodiments, the right notch (126) is located approximately midway between the front right corner (134) and the back right corner (136). In some embodiments, the right notch (126) extends from the support body face (110) to the support body bottom (112).

The support body (100) may have a label (144) on the support body face (110), to assist a user in correctly orienting the support body (100) during exercise.

The support body (100) has a support body depth (D; see FIGS. 4-6), which is the distance from the support body face (110) to the support body bottom (112). The support body (100) also has a support body length (L; see FIG. 3), which is the distance from the support body front (114) to the support body back (116).

The support body (100) further has a support body first width (W1; see FIG. 3), which is a distance along a line segment which is the shortest line segment between the support body left notch (124) and the support body right notch (126) along the support body face (110). The support body (100) furthermore has a second width (W2), which is the longest line segment parallel to the support body front (114) between the support body notches (126, 126) and the support body front (114). The support body (100) furthermore has a third width (W3), which is the longest line segment parallel to the support body back (116) and between the support body notches (126, 126) and the support body back (116). In preferred embodiments of the support body (100), W1 is less than W2 and W1 is less than W3. In some embodiments W1<W3<W2.

In some embodiments, W1 is in a range of 5 in. to 5.5 in, W3 is in a range of 5.5 to 6.0 in and W2 is in a range of 5.75 and 6.25 in, and W1 is less than both W2 and W3. In some embodiments, W1 is in a range of 5 in. to 5.5 in, W3 is in a range of 5.5 to 6.0 in, W2 is in a range of 5.75 and 6.25 in, W1 is less than both W2 and W3, and W3 is less than W2. In some embodiments, W1 is in a range of 13-14 cm, W3 is in a range of 14-15 cm and W2 is in a range of 15-16 cm, and W1 is less than both W2 and W3. In some embodiments, W1 is in a range of 13-14 cm, W3 is in a range of 14-15 cm, W2 is in a range of 15-16 cm, W1 is less than both W2 and W3, and W3 is less than W2. In some such embodiments, D is in a range of 4.5 to 5 in or 12-13 cm. In some such embodiments, L is in a range of 6.5 to 7.0 in or 16-18 cm. In some embodiments, other dimensions may be used, so long as the ratios of L, D, W1, W2, and W3 are maintained within these parameters. For instance, if the subject is a child or is in the lower 25 percentile for adult stature, the dimensions may be scaled accordingly in accordance with the invention.

The support body (100) advantageously possesses a combination of depth (D), first width (W1), second width (W2), third width (W3), and length (L) such that, when the support body (100) is placed between a user's thighs (each thigh fitting into the indentation formed by one of two notches (124, 126), the support body (100) holds the user's thighs in a suitable position (far enough apart, supported) to support and maintain the user's legs in a proper position during exercise to achieve isolation of target muscle groups and alignment of the hips. In some embodiments the support body (100) has a depth of approximately 5 in. (12.5 cm), a length of approximately 6.5 in. (17 cm), a first width of approximately 5.5 in (14 cm), a second width (W2) of approximately 6 in (15.5 cm) and a third width (W3) of approximately 5.75 in. (14.5 cm). (In some such embodiments, the IFD may be about 150.) Other measurements of D, L, W1, W2, and W3 may be used within the scope of the invention. In some embodiments, each of these measurements is within ±0.5 in (±1.3 cm) of the recited value in order to achieve proper alignment of the hips and isolate and work out the target true core muscle group.

In some preferred embodiments, the support body (100) comprises a support body foam core (180) within a cover (170). The support body foam core (180) should be made of a material that is substantially isotropic throughout, as anisotropic materials (such as air-filled balls or balloons) fail to provide the proper support for aligning the hips and isolating the proper muscle groups to achieve activation of one or more true core muscles. The support body foam core (180) should also be isotropically compressible, such that an equal pressure along any dimension will result in a similar degree of compression or "give." Compressibility of foam is generally indicated as the Indentation Load Deflection (ILD; synonymous with Indentation Force Deflection (IFD)), which is the weight in pounds (lb) necessary to compress a 15"×15"×4" block of foam 25%. Thus, a foam block having an ILD (IFD) of 150 is compressed 25% by a weight of 150 lbs. In some preferred embodiments, the support body foam core (180) should have an ILD (IFD) of at least 100 to about 200. In some embodiments, the support body foam core (180) should have an ILD (IFD) of 100-200, e.g. 125 to 175, in particular from 135 to 165, 140 to 160, or 145 to 155. Any density of foam may be used, though higher density foam is preferable from a durability standpoint, as foam density is generally an indicator of quality and durability. Foam density is measured in weight per cubic length dimension, e.g. pounds per cubic foot. In some embodiments a foam of density 2-8 $lb/ft^3$ may be used. In some embodiments, the foam density may be in a range of 4-6 $lb/ft^3$. Suitable foam includes white polyurethane, 150 IFD, 5 lbs density. In some embodiments it is considered critical to balance the compressibility and resistance of the support body foam core (180) and one or more of the W1, W2, W3, L, and D dimensions.

In some particular embodiments, the W1 and D dimensions are considered critical for achieving alignment of the hips and support of the muscle groups to achieve isolation and exercise of the true core muscles.

In some embodiments, the compressibility (IFD or ILD) is in a range of 135-165, 140-160, or 145-155, W1 is in a range of 5 in. to 5.5 in, W3 is in a range of 5.5 to 6 in and W2 is in a range of 5.75 to 6.25 in, and W1 is less than both W2 and W3. In some embodiments, the compressibility (IFD) is in a range of 135-165, 140-160, or 145-155, W1 is in a range of 5 in. to 5.5 in, W3 is in a range of 5.5 to 6 in, W2 is in a range of 5.75 and 6.25 in, W1 is less than both W2 and W3, and W3 is less than W2. In some embodiments, the compressibility (IFD) is in a range of 135-165, 140-160, or 145-155, W1 is in a range of 13-14 cm, W3 is in a range of 14-15 cm and W2 is in a range of 15-16 cm, and W1 is less than both W2 and W3. In some embodiments, the compressibility (IFD) is in a range of 135-165, 140-160, or 145-155, W1 is in a range of 13-14 cm, W3 is in a range of 14-15 cm, W2 is in a range of 15-16 cm, W1 is less than both W2 and W3, and W3 is less than W2. In some such embodiments, the compressibility (IFD) is in a range of 135-165, 140-160, or 145-155, D is in a range of 4.5 to 5 in or 12-13 cm. In some such embodiments, the compressibility (IFD) is in a range of 135-165, 140-160, or 145-155, L is in a range of 6.5 to 7.0 in or 16-18 cm. In some embodiments, other dimensions may be used, so long as compressibility and the relative ratios of L, D, W1, W2, and W3 are maintained within these parameters.

Figure 5:
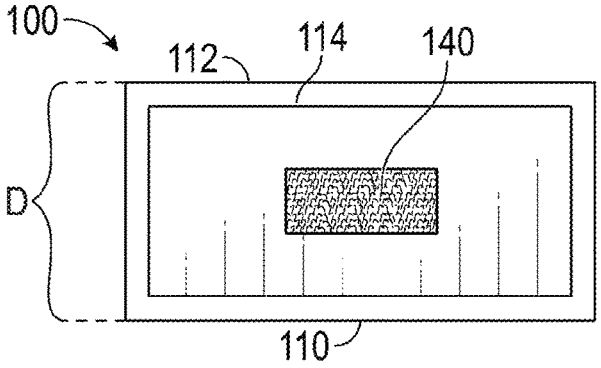
FIG. 5 shows a front view of a support body disclosed herein.
Figure 7:
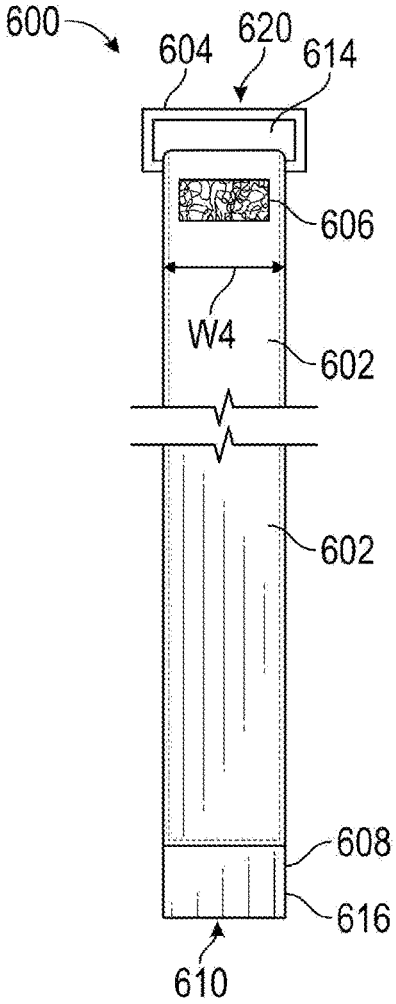
FIG. 7 shows a back side view of a support strap disclosed herein.
Figure 9:
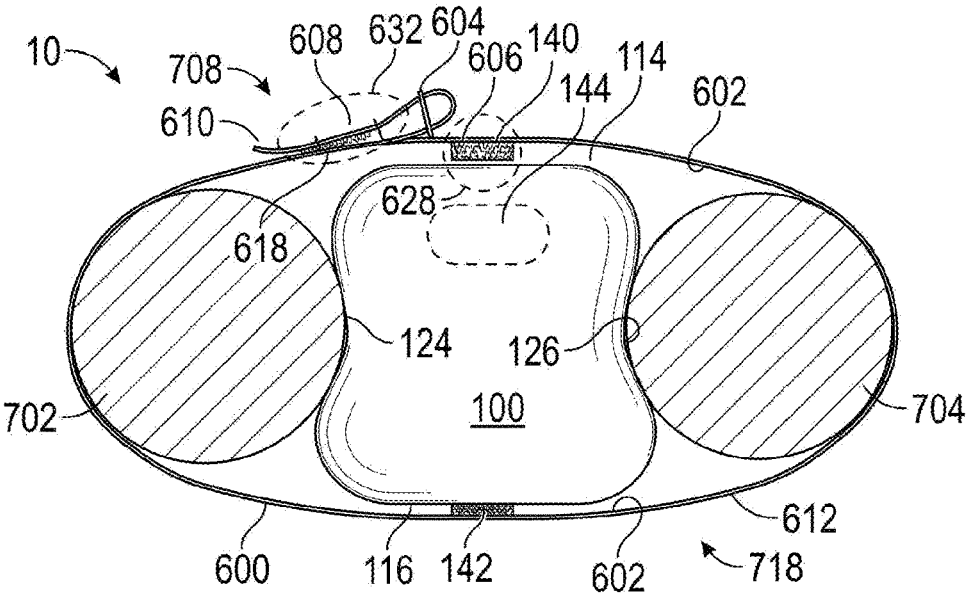
FIG. 9 shows a top cross-section view of a physical therapy system in use.
Figure 10:
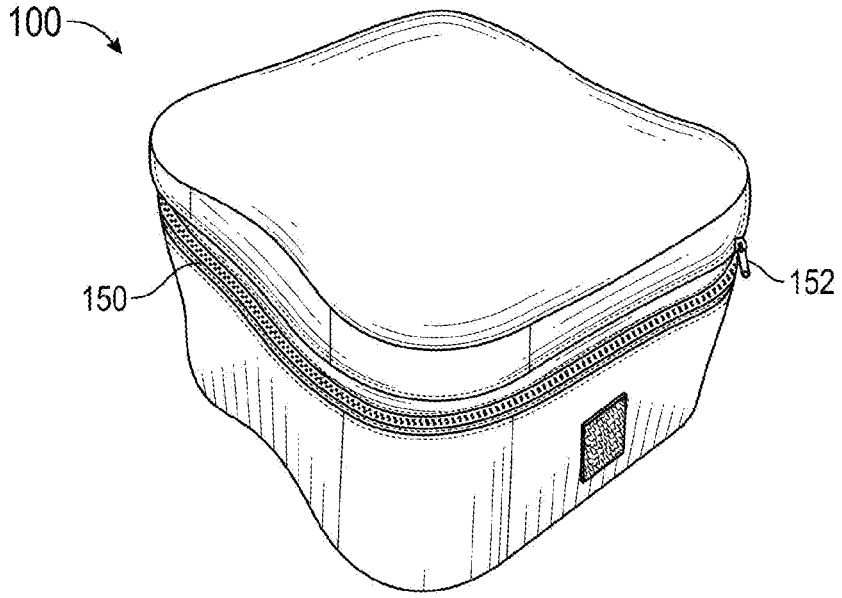
FIG. 10 shows a perspective view of a support body as described herein.
Figure 11:
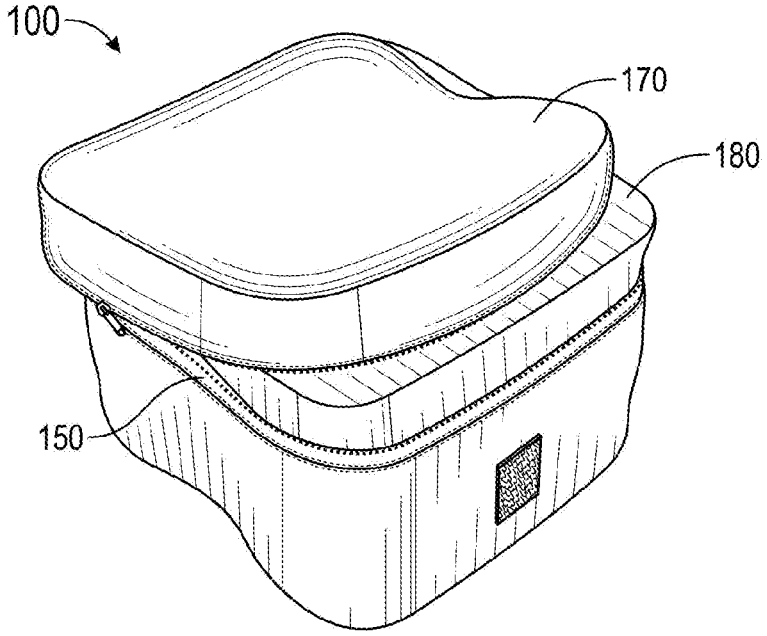
FIG. 11 shows a perspective view of a support body having its cover partially removed from the support body core as described herein.
Figure 12:
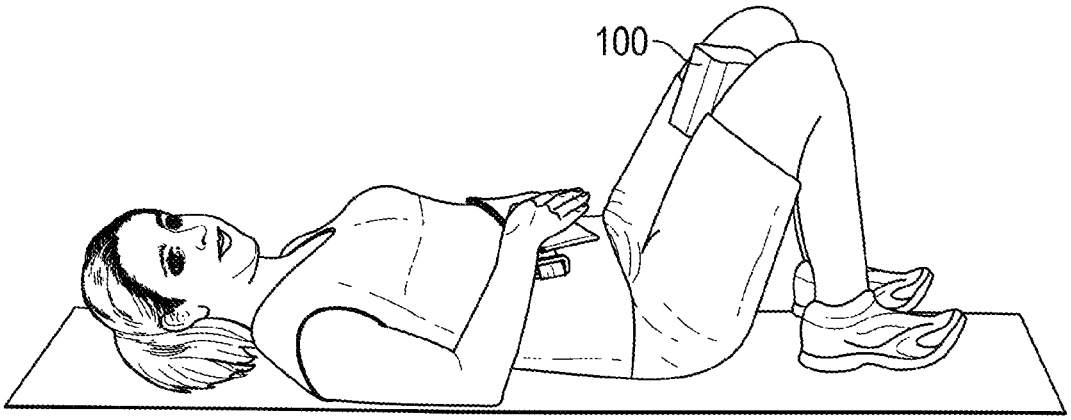
FIG. 12 shows a view of a supine user with bent knees using a support body.
Figure 13:
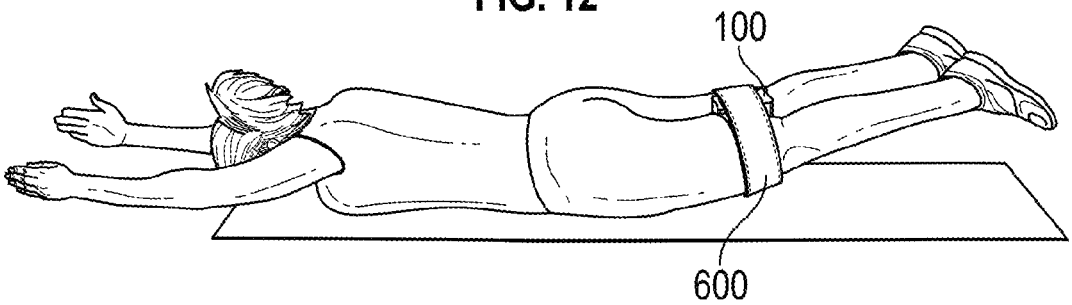
FIG. 13 shows a view of a prone user using a physical therapy system as described herein.
Figure 14:
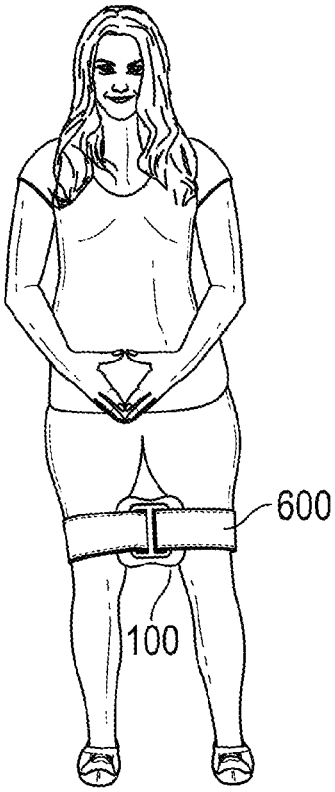
FIG. 14 shows a view of a standing user using a physical therapy system as described herein.
Figure 15:
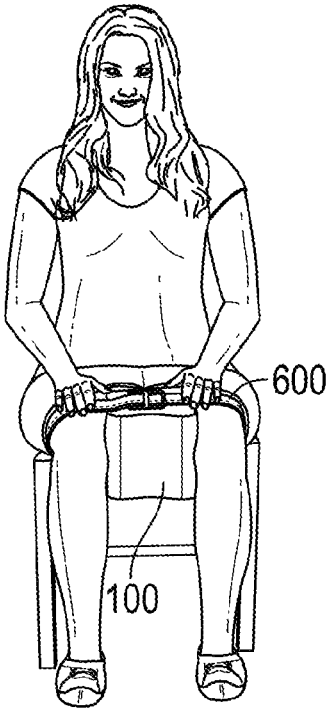
FIG. 15 shows a view of a seated user using the physical therapy system as described herein.

As seen in FIG. 5, which is a front view of the support body (100), the front surface (114) of the support body (100) may have a first hook and loop component (140) of a hook and loop fastener (628; see FIG. 9). The first hook and loop component (140) of the hook and loop fastener (628; see FIG. 9) may be either a hook component or a loop component. The first hook and loop component (140) of the hook and loop fastener (628; see FIG. 9) is selected to be complementary to a second hook and loop component (606; FIG. 7) of the first hook and loop fastener (628)—i.e., if the first hook and loop component (140) of the first hook and loop fastener (628) is a hook component, the second hook and loop component (606, FIG. 7) is a loop component, and vice versa. The function of the first hook and loop component (140) is discussed in more detail herein.

Figure 6:
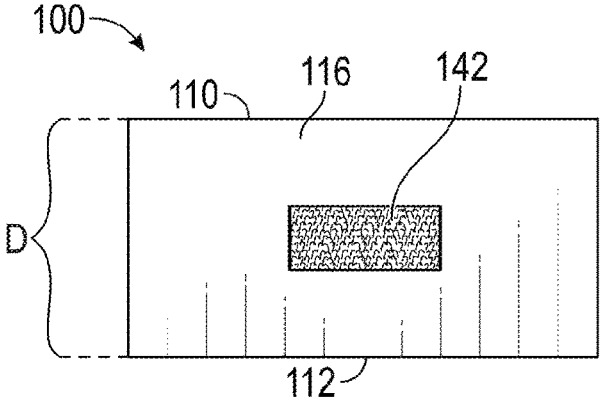
FIG. 6 shows a back view of a support body disclosed herein.

As can be seen in FIG. 6, which is a back view of the support body (100), the back (116) of the support body (100) may have a support body back hook component (142) of a hook and loop fastener. The function of the support body back hook component (142) is discussed in more detail herein.

Figure 8:
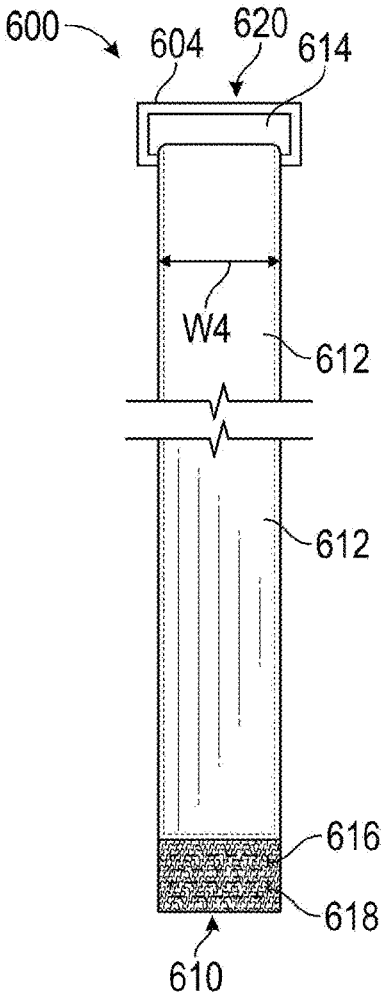
FIG. 8 shows a front side view of a support strap disclosed herein.

As seen in FIG. 1, in some embodiments, the physical therapy system (10) comprises a support strap (600). Turning to FIGS. 7 & 8, the support strap (600) has a strap first end (610), a strap second end (620), a support strap back (602) and a support strap front (612). At the strap second end (620) the support strap (600) has a strap buckle (604) having a buckle aperture (614) therein. Near the strap buckle (604) on the support strap back (602) there is a second hook and loop fastener component (606) of a hook and loop fastener (628; see FIG. 9). The second hook and loop component (606) of the first hook and loop fastener (628) is complementary to (i.e., it reversibly attaches to) the first hook and loop component 140) on the support body front (114; see FIG. 5).

At the strap first end (610) there is a strap end hook component (616), which may be a hook component of a hook and loop fastener. The strap end hook component (616) has a hook component back side (608), which may or may not have hooks, and a hook component front side (618), which preferably has hooks capable of engaging and forming with a fabric of the support strap (600) a reversible attachment. The function of the strap end hook component (616) is discussed in more detail herein.

A user puts on physical therapy system (10) as follows: FIG. 9 shows a cross-section top view of a physical therapy system (10) in use. A user has a front side (708), a back side (718), a left thigh (702) and a right thigh (704). The support body (100) is placed between the user's left thigh (702) and right thigh (704) such that the left thigh (702) fits within the left notch (124) and the right thigh (704) fits within the right notch (126) of the support body (100). In this orientation, the label (144) is visible to the user, as it faces the user's front side (708) and is visible from above the support body (100). This assists the user in orienting the support body (100) with the support body front (114) toward the user's front (708), and the support body back (116) toward the user's back (718). The support strap (600) is positioned so that the second hook and loop component (606) engages with the first hook and loop component (140) to form first hook and loop fastener (628). The strap (600) is wrapped around the user's legs (702, 704) so that the support strap back (602) contacts the support body back hook component (142). In some embodiments the support strap back (602) comprises a fabric that engages the support body back hook component (142) to form a reversible attachment between the support body back (116) and the support strap back (602) when the support strap (600) is in use. The strap end hook component (616) fits through the buckle aperture (614) in the support strap buckle (604) and is laid back to make contact with the support strap front side (616). In some embodiments, the support strap front side comprises a fabric that acts as a loop component of a hook and loop fastener (632) formed with the hook component front side (618) of the strap end hook component (616).

The support strap (600) should be long enough to wrap around the outside of a user's upper legs and allow the strap end hook component (616) to pass fully through the buckle aperture (614) and back to contact the support strap front side (602) when the support body (100) is placed between the user's thighs (702, 704). In some embodiments, the support strap (600) comprises a fabric. In some embodiments, at least a part of the support strap front (612) and the support strap back (602) comprise a fabric. The fabric used in the support strap (600) should be strong and durable enough to endure stretching along the length of the support strap (600) and soft enough to be comfortable for a user to use during exercise. In some embodiments, the support strap (600) comprises a fabric that has very little stretch, is soft, consistent, and/or is sufficiently fuzzy for the strap end hook component (616), the support body back hook component (142), or both, to engage with it to form secure, reversible attachment(s). One such type of fabric is a brushed tricot polyester, such as tricot brushed dazzle 100 percent poly. The support strap (600) may also comprise a lining, such as a fusing lining. The lining should be one that is suitable for sports apparel. The lining may comprise a fusing, such as a fusing 100 percent polyester. The lining may also comprise a base material, such a techno scrubs 95 percent polyester and 5 percent spandex blend.

The support strap (600) should be wide enough to be ergonomic when used in isometric exercise, such as when the support body (100) is placed between a user's thighs with the support strap (600) in place and the user pushes the user's legs away from one-another. In some embodiments, the support strap (600) is has a width (W4) that is 50-120% of the depth (D) of support body (100). In some embodiments, W4 is 60-110% of D. In some embodiments, W4 is 65-100% of D. In some embodiments, W4 is 70-100% of D. In some embodiments, W4 is about 70%, 71%, 72%, 73%, 74%, 75%, 76%, 77%, 78%, 79%, 80%, 81%, 82%, 83%, 84%, 85%, 86%, 87%, 88%, 89%, 90%, 91%, 82%, 93%, 94%, 95%, 96%, 97%, 98%, or 99%, or 100% of D. In some embodiments, W4 may be approximately the same as D or slightly larger or smaller.

The buckle (604) should be of a strong and durable material such that repeated isometric exercise will not cause the buckle (604) to weaken, bend or break. Suitable materials include plastics and metals used in the garment, luggage and sports-apparel industries for connectors that will be under a high degree of repeated stress. The buckle (604) should be of such a size that the aperture (614) is large enough for the first strap end (610) to pass through without puckering, so that the hook component front side (618) of the strap end hook component (616) lies flat against the strap front (612). Thus, in some embodiments the aperture (614) is as wide as W4 or slightly (1-5%) wider.

The strap end hook component (616) should be of such a size, and the hook component front side (618) should be of such size and character, that the hooks securely engage the strap front (612) and remain in place during exercise without slipping or breakage.

The support body (100) may also comprise a cover (170), similar to a seat cushion cover, which may be of a durable, washable fabric, such as nylon or a nylon blend. The cover (170) may sewed or otherwise held in place over the foam using any suitable means, such as a zipper, buttons, snaps, etc. The cover (170) provides a convenient means to attach the first hook and loop component (140) to the support body front (114) and the support body back hook component (142) to the support body back (116). The cover (170) may conveniently be removable from the foam core (180), and may also be washable.

While the physical therapy system (10) has been described above as comprising a detachable strap (600), in some embodiments the support strap (600) may permanently attached to the support body (100). For example, instead of being temporarily attached to the support body front (114) of the support body (100) by first hook and loop component (140) and second hook and loop component (606) to form the first hook and loop fastener (628), the first hook and loop fastener may instead be replaced with a permanent attachment, such as sewing the support strap (600) to the cover (170) of the support body (100), whereby, so long as the cover (170) is on the foam core (180), the support strap (600) remains affixed to the support body (100).

Other detachable means may be used to reversibly affix the support strap (600) to the support body (100). Means for reversibly attaching the support strap (600) to the support body (100) include hook and loop (hook and pile) fasteners, snaps, ties, twist-ties, etc.

Thus, in some embodiments, a system (10) may comprise a support body (100) and a support strap (600). The support body has L, D, W1, W2 and W3 as described hereinabove. The support system (10) comprises a means for detachably or permanently attaching the support strap (600) to the support body (100). The means for attaching the support strap (600) to the support body (100) may include hook and loop fasteners, snaps, ties, etc. The means for permanently attaching support strap (600) to the support body (100) may include sewing the support strap (600) to a cover (170) of the support body (100), as described hereinabove, although other means, such as gluing, fusing, laser welding, etc.

Exercises

In some embodiments, the support body (100) is placed between the thighs of a user. In some embodiments, the support body left side (120) interfaces with a first thigh of a user adjacent a first knee. In some embodiments, the support body right side (122) interfaces with a second thigh of the user adjacent a second knee. In some embodiments, the support strap (600) is wrapped around an outer periphery of the first thigh and the second thigh to hold the support body (100) firmly in position. In some embodiments, a pelvis is aligned via the placement of the support body (100). In some embodiments, while in this position, the user is equipped to do many different exercises. For example, the user may push out (i.e. move the thighs apart) against the support strap (600). The user may also squeeze (i.e. move the thighs toward one another) against the support body (100). The user may also simply hold the support body (100) in place between the thighs and perform one or more exercises described herein. The user may push out, squeeze, or simply hold the support body (100) in place while standing, sitting, kneeling, while in a plank or pushup position, while lying on the user's back (supine), with or without the knees bent, or lying prone, with or without the knees bent. The dimensions and materials of the support body (100) are considered critical for proper alignment of the pelvis, enhancement of pelvic stability, and strengthening and balancing the true core muscles.

In some embodiments, the support body (100) is placed on a waist side of the user. In some embodiments, either the support body left side (120) or the support body right side (122) interfaces with the waist side of the user. In some embodiments, the support strap (600) is wrapped around the support body (100) and an outer periphery of a waist of the user to hold the support body (100) firmly in position. In some embodiments, an arm is placed on the support body front (114). In some embodiments, the placement of the arm provides support for a shoulder without the use of a sling.

In some embodiments, the support body (100) is placed between the hands of the user. In some embodiments, the user pushes against the support body (100) for isometric exercise.

In some embodiments, the support body (100) comprises dense foam located therein. In some embodiments, the foam is closed-cell foam. In some embodiments, the foam is high-density foam. In some embodiments, the compressibility of the foam is considered critical, as described herein.

In some embodiments, the support body (100) is placed on a waist side of the user. In some embodiments, either the support body left side (120) or the support body right side (122) interfaces with the waist side of the user. In some embodiments, the support strap (600) is wrapped around the support body (100) and an outer periphery of a waist of the user to hold the support body (100) firmly in position for holding a baby thereon. In some embodiments, the baby can sit on the support body (100).

In some embodiments, the versatile physical therapy system (10) is used with a prescribed exercise program.

Kagel and Incontinence Program

Laying down on back, knees bent at about a 45 degree angle, feet about shoulder width apart, take the support body (100) to just about 1 to 2 inches above the knee, take the strap and wrap it around snug, but not too tight. Push out 3 10 second push outs with 5 second holds and 3 10 second squeezes with a 5 second rest. This will equal a 90 second exercise helping to align the pelvis. Make sure you align your pelvis before you start the kagel and incontinence program.

Kagel and Incontinence Program Exercise

This exercise can be done laying down or sitting. Place support body (100) between the knees and wrap strap around snug, but not too tight. Squeezing, not pushing out, the first exercise will be a 10 to 20 count consistent pulse pressure against the support body (100) (based on your level of strength) with a 10 second rest. Squeeze and hold for a 10 to 20 second consistent hold, with a 10 second rest. Repeat 3 times.

While doing these exercises make sure your pelvic floor is engaged and you are doing a pelvic tilt with your back pressed down to the floor. This short and easy exercise can help improve incontinence and help strengthen your pelvic floor using the kagel exercise.

These exercises will also be beneficial for pregnant women who have a weak pelvic floor. This is a safe and easy way to help stabilize your ligaments while you are pregnant (and after also).

TruKore Golf Program

The TruKore Golf Program will consist of 18 exercises for 18 minutes, 9 on the front end and 9 on the back end.

The first exercise is a rotation stretching exercise. You are on all fours (or on your back if you have knee problems). On all fours, put support body (100) between your knees, strap the strap snug, but not too tight. Squeeze and hold while rotating your arm up towards the ceiling with your head following your arm, squeezing the support body (100) which creates more stretch in your spine, and it also works your lower abs at the same time. Lower arm down and repeat the same on the other side. Repeat 10 times. We call this the arm, shoulder and torso rotation. This is called the Front 9.

This is called the Front 9 also but is the back extension with shoulder rotation. Lay on your back, place support body (100) between your knees, strap the strap snug, but not too tight, and roll over on stomach with support body (100) between your knees, squeeze the support body (100) lifting both legs about an inch off the floor, arms are out to your side, thumbs up toward the ceiling maybe 1 to 2 inches off the floor, hold for a 5 second count. Repeat 5 times, then push out on the strap and do the same exercise 5 times, with 5 second holds. This exercise can also be done with a golf club in hands lifting arms straight forward about 2 inches of the ground and lowering.

This is called the Front 9 push up. Put physical therapy system (10) on (see FIG. 9), get in pushup position, squeeze support body (100) and do 10 pushups squeezing the support body (100), which will engage the lower abdominals more.

This is called the Front 9 hip and leg lift. Laying on back (supine), put physical therapy system (10) on (see FIG. 9) and roll over onto your side, squeeze first lifting up and down for a count of 10, body must be straight and in line, second exercise, pushing out on the belt, repeat 10 times lifting your legs up and down together.

This is called the Front 9 lower and upper body Superman™ lift. On stomach (prone) with support body (100) between legs above the knees, bend both knees at the same time with feet up towards the ceiling, then lower legs, lift arms and then the legs straight looking like Superman™.

This is called the Front 9 lower ab roll up with golf club. Laying on back, bend your knees, feet off the floor, golf club in hands, support body (100) between your knees with the strap snug, but not too tight. Take a deep breath and roll up on to your bottom, extending arms up towards the ceiling and legs towards the wall. Repeat 10 times.

This is called the Front 9 lower back and neck and shoulder stretch. On all fours, place support body (100) between your knees. Lean back with your arms extended straight out in front of you with your elbows and hands touching the ground while sitting back on your knees, and while squeezing the support body (100). Do 3 10 second holds. This is a good stretch.

This is called the Front 9 plank. Put physical therapy system (10) on (see FIG. 9) while laying on your back, roll over to your stomach, come up on elbows and feet, squeeze support body (100) while holding this position for a 40 second hold. You can push out doing this also.

This is called the Front 9 upper torso rotation and lower ab roll up. Laying on your back, knees bent, feet on the floor, golf club in your hands, do a partial sit up and then rotate your upper torso with golf club side to side while squeezing the support body (100). Repeat 10 times.

Back 9 Exercises

Back 9 glute hamstring lift. Laying on your back, knees bent and feet on the floor, support body (100) between your knees, squeeze and lift your bottom up about 5 inches from the floor while squeezing the support body (100), and then lower down slowly. You can do this also pushing out lifting and lowering.

Back 9 lower and upper lumbar separation. Laying on back, support body (100) between your knees, golf club in hand, knees go one way, and golf club and arms go the opposite way. The support body (100) helps to keep your back from getting injured. Hold for 5 second hold. Repeat 5 times.

Back 9 lower ab. Laying on back, support body (100) between your knees, golf club in hand, golf club and legs straight up towards the ceiling, shoulder blades down on the ground, and lift your legs toward the ceiling while squeezing the support body (100), this will work the lower abs. You can also do this exercise pushing out on the belt.

Back 9 lower ab and love handles. Put physical therapy system (10) on (FIG. 9), lay on your bottom, legs straight, elbow bent, torso raised up off the floor putting weight on your elbow and lift legs up and down while squeezing the support body (100). Repeat 10 times. Roll over and repeat the same on the opposite side of your body.

Back 9 sit up. Laying on your back, support body (100) between your knees, feet on the floor, hands behind head with your elbows out, while squeezing the support body (100) lift your upper chest and hold for a 5 second hold. Repeat 10 times.

Back 9 standing. Place support body (100) between knees, back against the wall with your knees bent, squeezing the support body (100), golf club in hand, stretch overhead, working your quads and lower abs while squeezing the support body (100), hold for a 10 to 20 count. Go back down pushing out against the strap. Repeat 5 times.

Back 9 bicep curls. Weights in hand, while squeezing support body (100) with your knees bent, do a bicep curl 10 times.

Back 9 alternating arms with weights. Back against the wall, alternating one arm at a time only shoulder height while squeezing the support body (100). Do this 10 times.

Back 9 leg circles for lower abs. Laying on your back, arms out to the side on the floor, legs up towards the ceiling with support body (100), squeezing the support body (100) circling your legs 10 times each direction.

This support body (100) can also be used as a golf training tool to help increase range of motion in spine, shoulders. This can also facilitate the right muscles to be used in your golf swing.

Place support body (100) while standing, tighten strap snug, but not too tight, use golf club in your hand while squeezing the support body (100) practicing your golf swing. Then push out while practicing your golf swing. This has been proven with a golf machine while golf pro using the support body (100) to help the ball go further and have more accuracy in your swing. This can also be used while putting to help the ball keep a straight line to the hole. Golfers can also use this as a warm up tool. Suggested to use either standing or sitting first, align the pelvis with the 3 10 second push outs first and then the 3 squeezes.

Fitness Program

This program is for beginner, intermediate, and advanced. Start with the Alignment program 90 second push out and squeeze exercises. This program is also great to be used with Pilates.

25 or 45 minute programs with support body (100).

25 minute program consists of stretching with the support body (100) and squeezing or pushing out at all times will keep your back in a safer position while doing these exercises, and you will use more of your true core. This program is a safe and easy way to get a better work out and save years of wear and tear on your spine and all joints in your body and also keeping you from over stretching which can be damaging to your body.

Laying on back with knees bent and feet on the 45 degree angle, hands behind head supporting neck, sit up partially and go straight and to each side. Can do a sit up with 5 second holds. This can also be done with legs up, bent into a table top position.

Bridge is a gluteus butt exercise used with the support body (100) to strengthen. Put physical therapy system (10) on (see FIG. 9). Then lay on back, feet down on ground, and lift butt about 4 to 5 inches off the ground pushing out 10 times and then squeezing 10 times.

Lower back stretch with support body (100) and twisting your arms and legs opposite of each other on your back, helping to stretch out the lower back.

Using support body (100) to stretch the shoulders out kneeling on knees and arms going each directions on the floor.

Using support body (100) laying down, sitting and standing this exercise can increase range of motion and flexibility.

This exercise program will also help you get started in all other exercise programs and is great for athletes.

Some of the same exercises as used in the golf program will also be used in all of them, but just change the name to fitness, and they will not be used with a golf club.

TruKore Pain Program

Before we start the pain program, do these 3 stretches.

Hamstring stretch—both legs bent and on your back, one leg at a time, clasp hands behind your knee and pull your leg gently towards your chest. Do 3 times on each leg holding for a 10 second hold.

Lower and upper back rotation stretch with support body (100)—support body (100) between your knees, arms will go one way, and the knees will go the opposite way squeezing the support body (100) making sure there is no strain on your lower back.

Press up—with support body (100) in between knees, squeezing support body (100), legs down, come up on elbows, 2 to 5 second hold, then go back down.

Beginner—8 exercises for 8 minutes.

Using the support body (100):

Support body (100) alignment exercise: Taking the support body (100) lay down on your back, this can be done in bed or on the floor, knees bent at a 45 or more degree angle, take the support body (100) and put it between your knees, take the outside strap attached to the support body (100) with the hook and loop fasteners, open up the belt and wrap it around the outside of your legs below the knee. Strap the belt and make it snug, but not too tight. Knees should be about shoulder width apart or close. Make sure your back is down, lower stomach muscles tight. Push out with good pressure without straining the muscles keeping the back down while doing this.

Three 10 second sets pushing out with equal pressure on each leg, with a 5 second rest in between each set (can rest longer if needed based on the tiring of the muscle). If you need a rest, take a 10 second rest.

Second exercise is squeezing (leaving the belt strap on) and now squeezing three 10 second squeezes, strong squeeze without over stressing the muscles or hurting yourself with 5 second rest in between each exercise.

This TruKore alignment exercise in 90 seconds can help in aligning your SI joint which can help relieve lower back pain in the body, it can also help to relieve other pain sites in your body. This isometric exercise can help to realign your whole body creating a more balanced body overall. Make sure that if you have any pain or strain in your muscles or ligaments, try to first push out easier or squeeze easier to see if this helps, if not, stop the exercise. This exercise strengthens your true core which is your lower abdominals below the bellybutton, your hips, glutes, inner thighs, also is used as a kagel exercise or helping with bladder control. Also helps strengthen your smaller muscle groups and can work as a stabilizer for the pelvis because our ligaments can become overused. This isometric exercise can help create a more stabilized and stronger pelvic and lower core. Most of us work the larger muscle groups with weights, but we forget to use the smaller muscle groups which the isometric exercises do. When you injure yourself your back or other body parts, in rehab, they use isometric exercises first to strengthen then weight training. This is true for even athletes when injured. This exercise can also be done in sitting, but if in pain, it is better if done on the bed or on the floor.

Sit up with pelvic tilt: True core abdominal exercise. Laying on your back, knees bent with support body (100), 45 degree angle, squeeze with your back down making sure that you are working your lower abs as you are squeezing, holding for a 5 to 10 second hold, start with a pelvic tilt tightening lower abs for 5 to 10 second holds, putting your hand below your bellybutton making sure you are using those lower muscles. Push your back down to the floor. Do this 8 times, then take both hands behind your head clasping your fingers together making sure your head is supported, do 8 more pelvic tilts with a partial sit up holding 5 seconds and then lower down. Easy exhale when come up, count out loud 5 seconds and then lower back down making sure your squeezing the support body (100) each time you come up. Second part of the same exercise is pushing out on the belt and sitting up with back down doing this 8 times.

Sit up with pelvic tilt and rotation. Squeeze support body (100) and rotate upper body keeping back down, elbow towards each opposite knee.

The bridge. On your back with knees bent at 45 degree angle, keeping physical therapy system (10) on (see FIG. 9), arms to the side of your body, lift your bottom up squeezing your glutes about 4 or 5 inches off the ground, squeezing the support body (100) while lifting, hold for a 8 second hold, lower down slowly, do this 8 times. The next 8 exercises will be pushing out on the belt for 8 second easy push out, not too hard, lowering down slowly.

Lower body rotation. On your back, support body (100) between your knees, arms out to side, go side to side squeezing support body (100) and keeping abs tight, only go as far as you can without any back strain, should feel easy stretch.

Arm strengthening (bicep and tricep). Laying on your back with your knees bent, feet on the ground, 45 degree angle, keep your back down using your lower abs squeezing the support body (100) while taking 3 to 5 lbs. weights in your hands and lifting your lower arms (curls) while also keeping your abs working at the same time with the support body (100). Using your abs, squeezing the support body (100) you can do tricep extension on your back. Your arm is straight up towards the ceiling, support your elbow with the other hand, put weight in the hand of the arm that you are exercising and extend and bend working your triceps and lower abs. Do 2 to 3 sets of 8 for these exercises.

Superman™. Leave physical therapy system (10) on (see FIG. 9), roll over onto stomach, arms straight out in front of you, squeeze the support body (100) with straight legs and arms out in front, lift arms and legs at same time, only about 1 to 2 inches holding for 5 second hold and then relax. Any back pain stop this exercise. Do only 1 set of 8.

Upper body rotation on all fours. With support body (100) between your knees (you do not need the belt with the support body (100) for this exercise), squeeze using your lower abs rotate your right arm to the side following with your head and then lower down, repeat on other side for a total of 8 times. Squeeze support body (100) using lower abs, lift one arm and then the other straight forward.

As used herein, the terms "about" and "approximately" mean±10% of the referenced number.

The physical therapy system (10) or the support body (100) according to the present invention may be used in one or more of the foregoing exercises. Many sports are associated with over-stretching of various ligaments and/or tendons, resulting in destabilization of joints and/or associated muscle soreness. One or more of the foregoing exercises with the physical therapy system (10) or support body (100) may strengthen the muscles associated with joints whose associated ligaments or tendons have been over-stretched. For example, destabilization in the pelvic or lumbar-pelvic region, may be addressed by engaging in one or more of the foregoing exercises to strengthen muscles in the pelvic or lumbar-pelvic region, thereby stabilizing the hips and/or lower back. In some cases, stabilizing the hips and/or lower back may correct compression of vertebrae, especially in the lumbar region. In some cases, stabilizing the hips and/or lower back may reduce pain in the hips and/or lower back. In some cases, stabilizing the hips and/or back may correct rotation of the hips. Evidence for such correction may be seen in cases where, prior to use of the physical therapy system (10) or the support body (100), one of a subject's legs appears longer than the other due to rotation of the hips, but after use of the physical therapy system (10) or support body (100), the subject's legs appear to be closer to the same length. (The apparent relative length of a subject's legs may be visualized with the subject in the supine position, e.g. lying on the subject's back on an exercise mat.) Continued use of the physical therapy system (10) or support body (100) may result in further improvement in a subject's pain levels and/or other physical indicia, such as hip rotation and relative length of the subject's legs.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A physical therapy support body (100), comprising: a support body face (110), a support body bottom (112), a support body front (114), a support body back (116), a support body left side (120), a support body right side (122), a left notch (124), a right notch (126), a support body first width (W1), a support body second width (W2), and a support body third width (W3), wherein the support body first width (W1) is less than the support body second width (W2) and the support body third width (W3); and wherein the support body third width (W3) is less than the support body second width (W2), wherein the support body first width (W1) is a shortest width between the left notch (124) and the right notch (126), wherein the support body first width (W1) is between the support body second width (W2) and the support body third width (W3) such that the support body second width (W2) transitions to the support body first width (W1), which transitions to the support body third width (W3), wherein the physical therapy support body (100) comprises a support body foam core (180) within a cover (170), and wherein an entirety of the physical therapy support body (100) is configured to be received between thighs of a user.

2. The physical therapy support body (100) of claim 1, further comprising a front left corner (132), a front right corner (134), a back left corner (138) and a back right corner (136).

3. The physical therapy support body (100) of claim 2, wherein one or more of the corners (132, 134, 136, and 138) are rounded.

4. The physical therapy support body (100) of claim 1, wherein the physical therapy support body (100) has a support body depth (D), and a support body length (L).

5. The physical therapy support body (100) of claim 4, wherein the physical therapy support body (100) possesses a combination of the support body depth (D), the support body length (L), the support body first width (W1), the support body second width (W2), and the support body third width (W3), wherein the left and right notches (124, 126) each form an indentation configured to respectively receive a user's thighs therein, and wherein the physical therapy support body (100) is suitable to support and maintain legs of the user in a proper position during exercise to achieve isolation of target muscle groups and alignment of hips of the user.

6. The physical therapy support body (100) of claim 1, wherein the support body foam core (180) is made of a foam material having an ILD (IFD) of 130-170.

7. The physical therapy support body (100) of claim 1, wherein the support body foam core (180) is made of a foam material having an ILD (IFD) of 140-160.

8. A physical therapy system (10) comprising the physical therapy support body (100) of claim 1 and a support strap (600), wherein the support strap comprises a first end (610) and a second end (620) and the physical therapy system (10) comprises a means for attaching the support strap (600) to the physical therapy support body (100).

9. The physical therapy system (10) of claim 8, wherein the means for attaching the support strap (600) to the physical therapy support body (100) comprises a detachable attachment means.

10. The physical therapy system (10) of claim 9, wherein the detachable attachment means for attaching the support strap (600) to the physical therapy support body (100) comprises one or more hook and loop components.

11. The physical therapy system (10) of claim 8, wherein the means for attaching the support strap (600) to the physical therapy support body (100) comprises a permanent attachment means.

12. The physical therapy system (10) of claim 11, wherein the permanent attachment means comprises the support strap (600) being sewed to the physical therapy support body (100).

13. An exercise method comprising holding the physical therapy support body (100) of claim 1 between the user's thighs.

14. The exercise method of claim 13, further comprising holding the physical therapy support body (100) in place with a support strap (600).

15. The exercise method of claim 13, comprising squeezing the physical therapy support body (100) between the user's thighs.

16. The exercise method of claim 14, comprising the user applying pressure outward against the support strap (600).

17. The exercise method of claim 13, further comprising:

a. doing at least one pushup;

b. doing at least one plank;

c. practicing a golf swing;

d. or performing a Kegel exercise.

18. The exercise method of claim 13, wherein the user practicing the exercise method experiences one or more of the following benefits: decreased pain, increased muscle strength, reduced severity of incontinence, increased joint stability, reduced hip rotation; equalizing leg length or apparent leg length.

* * * * *